US005575473A

United States Patent [19]

Turner

[11] Patent Number: 5,575,473

[45] Date of Patent: Nov. 19, 1996

[54] GOLF CLUB

[76] Inventor: Terry S. Turner, c/o Electra, 550A Vista Blvd., Sparks, Nev. 89434

[21] Appl. No.: 296,344

[22] Filed: Aug. 25, 1994

Related U.S. Application Data

[63] Continuation-in-part of Ser. No. 184,385, Jan. 19, 1994, and a continuation-in-part of Ser. No. 980,458, Nov. 23, 1992, Pat. No. 5,322,285.

[51] Int. Cl.[6] ..... A63B 53/14

[52] U.S. Cl. ..... 473/298; 473/303; 473/305

[58] Field of Search ..... 273/80 R, 80 B, 273/81 R, 81.3, 167–175, 77 R, 77 A, 193 R, 67 R, DIG. 23, 80.1, 80.2, 80.3, 80.4, 80.5, 80.6, 80.7, 80.8, 164.1, 81 A, 81 B, 73 J, 75, 67 DB

[56] References Cited

U.S. PATENT DOCUMENTS

| | | | |
|---|---|---|---|
| 1,680,447 | 8/1928 | Bryant | 273/80 R |
| 2,133,696 | 10/1938 | Hall | 273/81 R |
| 3,539,185 | 11/1970 | Andis | 273/80 R |
| 3,782,725 | 1/1974 | Giambazi | 273/81 B |
| 3,871,649 | 3/1975 | Kilshaw | 273/77 A |
| 3,897,058 | 7/1975 | Koch | 273/81 R |
| 4,016,640 | 4/1977 | Briggs | 273/72 R |
| 4,113,249 | 9/1978 | Beery | 273/78 |
| 4,122,593 | 10/1978 | Braly | 273/77 A |
| 4,186,924 | 2/1980 | Southey | 273/81 B |
| 4,541,631 | 9/1985 | Sasse | 273/170 |
| 4,736,949 | 4/1988 | Muroi | 273/73 J |
| 4,826,168 | 5/1989 | McGuire | 273/81.2 |
| 4,954,198 | 9/1990 | Viellard | 273/80 R |
| 4,979,743 | 12/1990 | Sears | 273/81 R |
| 4,988,102 | 1/1991 | Reisner | 273/81 A |
| 5,058,891 | 10/1991 | Takeuchi | 273/81 B |
| 5,131,652 | 7/1992 | Peng | 273/81 R |
| 5,160,139 | 11/1992 | Soong | 273/81 R |

*Primary Examiner*—Sebastiano Passaniti
*Attorney, Agent, or Firm*—L. Lee Humphries

[57] ABSTRACT

A golf club has a grip and a shaft which extends into the grip. The grip has an enclosed cavity and a partially-enclosed cavity between the inner diameter of the grip and the outer diameter of the shaft. The enclosed cavity provides a low-frequency feel and if a small cavity is also provided, a high frequency sound is provided. A matched set of golf clubs, as to feel or sound, or both, is readily obtained by such invention.

18 Claims, 6 Drawing Sheets

GOLF CLUB

This application is a continuation-in-part of application Ser. No. 08/184,385, filed Jan. 19, 1994, entitled Golf Club, by the same inventor as herein. It is also related and a continuation-in-part of Ser. No. 930,453, now U.S. Pat. No. 5,322,285, filed Nov. 23, 1992, entitled Golf Putter, by the same inventor as herein.

This invention is a golf club having a grip having one or more cavities, or air gaps. Preferably, but not necessarily, the grip is of high modulus of elasticity and is constructed of one or more metals, alloys, metal compounds or metal mixtures, although other materials such as wood or plastic may be used. Such cavity or cavities in the grip are advantageously used in all golf clubs, that is, putters, irons, woods and playing utility clubs, whether such golf clubs are made of wood, metal, plastic or other materials. The term "woods" herein includes, without limitation, drivers, metal woods, ceramic woods, graphite composite woods, persimmon woods and various other clubs, all of which are commonly called "woods". The term "playing utility clubs" herein includes irons, wedges, and chippers and similar golf clubs.

A golf club, constructed as taught herein, will provide the golfer with a solid feel which gives extraordinary control to the user. The club further provides a sound which depends upon the strike, which is desired by many golfers.

In addition, this invention allows a set of golf clubs to be manufactured which are closely related in feel or sound, or both, or which vary in a consistent manner as to feel or sound, or both. Thus, matched sets are more readily manufactured.

In the putter, the grip, shaft and head may all advantageously, but not necessarily, be constructed of high modulus of elasticity material or materials, such as, but not limited to, metals, alloys, metal mixtures or metal compounds.

The putter can be made very stiff and will provide a very desirable, solid, low-frequency feel. In the irons, woods and playing utility clubs, the shaft will likely not have such high modulus of elasticity. That is, the shafts of the irons, woods and utility clubs are less stiff and more "whippy". Nevertheless, in all clubs, a grip having a high modulus of elasticity is preferred, but is not necessary, in the practice of this invention.

For the stiffest and best feel, the grip of the invention is connected to the shaft with either (a) an intervening material which is similar to the material of the grip herein, (b) directly, with no intervening, or connecting, material, (c) an epoxy, adhesive, resin or other material which is modified to have a modulus of elasticity which is substantially higher than the epoxy or adhesives which were previously used. Such modified material, for example may be an epoxy or thermoplastic resin having a metal filler which gives the epoxy a modulus of elasticity of approximately 100,000 psi or greater. However, the grip may be connected to the shaft in the ordinary manner, using customary means, including, but not limited to presently-used epoxies, adhesives, and other means. While the effect of the invention is lessened by using customary epoxies and adhesives, it does not appear that their use seriously degrades the performance of the golf club of this invention.

The full advantage of the invention is best obtained by using no intervening material which does not have a high modulus of elasticity, between shaft and grip, and between shaft and head. This may be accomplished by welding, brazing, bonding, soldering, fusing, swaging, pinning or keying the shaft to the head and to the grip, or by similar method. In one preferred embodiment, an intervening material, having a high modulus of elasticity, between grip and shaft, in the shape of a collar around the shaft, as described hereafter, is preferably directly connected to the grip and the shaft by welding, brazing, bonding, soldering, fusing, swaging, pinning, keying or similar method. Nevertheless, metal-filled epoxy, customary epoxy, adhesive or other customary adhering means used by those skilled in the art may be used to connect the grip to the collar and the collar to the shaft and the shaft to the head of the golf club.

In the embodiment using all-metal grip and shaft, or all-metal shaft and head, thermofusible bonding, with or without thermofusible adhesives, works very well. In such cases, the shaft, grip or head may readily be changed because of their ability to withstand heat.

All of such embodiments provide superior sound and feel over golf clubs previously in use. In fact, the grip of the invention, having one or more cavities may still be covered by a standard grip of leather, rubber, rubber composition, plastic or other resilient or flexible material and a superior sound and feel is still obtained, although somewhat dampened by the resilience of such covering.

BACKGROUND

A playing golf club should provide low-frequency feel, or vibrations, to the hands of the golfer. Feel and sound are both generated at ball impact. In the irons, and particularly in the putter, the feel should be more intense so as to provide increased precision in controlling the ball. That is, the putter should provide a feeling of precision in controlling the ball. High frequencies should not be felt even though some golfers may desire to hear high frequencies. Nevertheless, as to feel, high frequencies should be damped, or diffused, and not felt. Mid-range frequencies should be diffused or suppressed enough so as not to be felt or heard and, consequently, confuse the golfer.

Each golf club has a "sweet spot" on the face of the head. The "sweet spot" is the point on the face of the head, in which the golf ball is best struck and which moves the ball in a straight direction. The "sweet spot" is located on the face of the head on a line passing through the center of inertia of the head. When a ball is struck at the "sweet spot", there is a solid feel to the strike and little or no torque is imparted to the club. Presently, golfers test for the "sweet spot" on a putter by holding the face of the putter horizontally and dropping the ball on the face. They then listen for a "chunk", or low frequency, sound rather than a "ring", or high frequency sound. The "chunk" sound denotes the "sweet spot". The "sweet spot" area is a general area around the "sweet spot". If the golfer hits within the "sweet spot" area, it provides an acceptable golf shot. The "sweet spot area" may be approximately 2.5" in length, on, say, a face which is approximately 4" long. The best part of the "sweet spot" area, in which to hit the ball, is approximately one third the diameter of a golf ball in width, or 0.56", although striking within a distance of 0.8" around the "sweet spot", will likely be quite an acceptable hit.

In one embodiment of this invention which provides and enhances the high frequency sound, the golfer will hear a "ring" when he drops the ball on the "sweet spot" of the club.

It is intended that the ball be struck on the "sweet spot" on the face of the golf club, which is generally at or near the central area of the face. It is common for golfers to strike the ball within the "sweet spot" area. However, it is also common to strike outside the "sweet spot" area, which is a bad strike.

SUMMARY OF INVENTION

This invention comprises a golf club which has at least one cavity between the grip and the shaft which extends into the grip. The cavity in the grip of the invention provides a low-frequency feel to the golfer. High frequency vibrations or the mid-frequency vibrations generated when a golf ball is struck, if felt in the grip, tend to destroy the feeling and psychology of control. If the golfer feels only the low frequencies, it gives a solid feel to the golf club and gives the golfer a reference, to be sought in subsequent strikes or strokes. Therefore, in the golf club of the invention, and this is especially true in the case of the putter, the low frequency vibrations are generated and conveyed in the golf club and will be felt in the hands of the golfer, but the high frequency or mid-frequency vibrations will not be felt. This is due in some cases to high frequencies and mid-frequencies being dissipated, or suppressed, and, in other cases, by the high frequencies and mid-frequencies being overwhelmed and masked, that is, concealed, by the intensity of the low frequency vibrations.

Many golfers also prefer to hear a low frequency sound as well as feel a low frequency in their grip. On the other hand, other golfers prefer to hear a high frequency sound and, for them, hearing a high frequency sound, when the ball is struck correctly, enhances their control in subsequent playing. Still others have best control when they hear both high and low frequencies when the ball is struck correctly. Still others have best control if they hear no sound when the ball is struck correctly. The device of the invention can be utilized to provide no sound, high frequency sound or low frequency sound, as desired.

The device of the invention diffuses or suppresses the mid-frequency vibrations, whether of sound or feel.

A low frequency feel golf club and the various embodiments of low-frequency sound, high frequency sound and no sound, are taught herein. This is achieved through the use of particular embodiments of the grip, described hereafter, which has one or more cavities, or air gaps, and, preferably, a high modulus of elasticity.

A golf club having such grip, connected to the shaft as taught herein, transmits the low frequencies to the golfer and provides an extraordinary feel which the golfer will come to expect and anticipate after having used the club for a time. That is, a correct strike will cause a feel to the golfer which he comes to recognize and will seek to repeat. Thus, the golfer's game is improved.

The preferred embodiment of the invention is a golf club having a metal grip. It may or may not have a flexible or resilient covering.

Plating the entire golf club, after it is assembled, gives it a desirable, unitary construction. The golf club of the invention allows lower frequencies to be transmitted to the user so that he feels a "solid" touch and does not feel the mid-frequencies or the high frequencies which are somewhat like a "tickle." In this regard, high frequencies are defined as those above approximately 4000 Hz, mid-frequencies are defined as those between approximately 1200 Hz and approximately 4000 Hz and low frequencies are defined as those approximately 1200 Hz and below, to approximately 20 Hz. Frequencies as low as approximately 20 Hz, although not heard, are often asserted to be sensed by a person.

Plugging the shaft at both ends further enhances the low frequency feel and sound of the club having a grip as taught herein.

Utilizing no flexible or resilient materials between the golfer's hands or gloves and the shaft further enhances the low frequency feel. On the other hand, golfers are used to tacky gloves and grips, which give them assurance of their grip. Therefore, it may be desirable to provide a flexible or resilient covering on the grip even though the feel and the sound may be somewhat lessened.

Connecting the shaft to the head without flexible or resilient materials, maintains and provides further enhancement of the low frequency feel. In the putter, this low frequency feel provides much better control of the strike.

Thus, the desired low frequency feel, in a golf club, is best enhanced by the construction of a cavity between the grip and the shaft, by the grip having a high modulus of elasticity and by connecting the grip to the shaft without any connecting material having a modulus of elasticity below 100,000 psi. Nevertheless, the cavity, or air gap between the grip and the shaft, by itself, will provide a low frequency feel which enhances the control by the golfer.

In the putter, for best results, the shaft should have a high modulus of elasticity closely-related to that of the grip. In the putter, I prefer a constant diameter shaft over a tapered shaft, although a stiff, tapered shaft or a stiff, fluted shaft may be used.

In the woods and playing utility clubs, there may be more flexibility in the shaft. However, a great deal of the desired low frequency feel can be obtained by using the grip of the invention, in which the grip is made of a material having a high modulus of elasticity, and using welding, brazing, bonding, soldering, fusing, swaging, pinning or keying or similar connecting method to connect the grip to the shaft. The shaft may similarly be connected to the head.

The material for making a golf club, including the grip, may be a pure metal, such as, but not limited to, steel, low-carbon steel, stainless steel, titanium, aluminum, magnesium, zinc, copper, beryllium copper, bronze and brass or it may be alloys, metal mixtures or metal compounds. Various other materials may be used such as, but not limited to, polymers, carbon, graphite, Kevlar, boron, and graphite boron. Ceramics may also be used. A preferred, economical material is low carbon steel. The modulus of elasticity, for such steels is approximately 30,000,000 psi. Malleable cast iron is approximately 23,000,000 psi. Gray cast iron is approximately 15,000,000 psi. These values of modulus of elasticity are considered high modulus of elasticity and are preferable. The modulus of elasticity of wood, on the other hand, is 2,000,000 psi or below and, therefore, is not closely-related to that of the above metals and is considered to be a low modulus of elasticity. Such low modulus of elasticity is not as suitable, but will provide some of the benefits of the invention. Consequently, it is desired, but not necessary, that the modulus of elasticity in the grip be substantially in excess of 2,000,000 psi. Golf shafts having moduli of elasticity substantially in excess of 2,000,000 psi are readily available in the commercial market.

In the preferred embodiment of the putter, the grip is of the same material as the shaft and the head, although the grip may be further treated for better feel and for better control by the hands, by etching, bead blasting, machining, splatter or other coating. Such grip may also be covered with the grips commonly available, or with a thin tape, but the feel of the low frequencies is somewhat dampened.

When the invention is used in a wood or playing utility club, the grip may be constructed of a material having a modulus of elasticity substantially different than that of the shaft or the head of the golf club. The grip is preferably constructed throughout of a material having a high modulus of elasticity. Such grip gives a solid feel that enables the golfer to more accurately repeat his strikes. In the irons, woods and playing utility clubs, the shaft will have a modulus of elasticity which is substantially less than that of the shaft in the putter. In the playing utility clubs, the shaft of a sand wedge may approach the stiffness of the shaft in the putter. In the woods, the head may be of wood, metal, graphite, a plastic, such as Kevlar, Cycolac, high molecular weight compounds, or other hard material or mixtures, alloys, metal mixtures or metal compounds. Wood heads commonly have inserts, in their faces, of other materials.

The grip, whether for putter, iron, wood or playing utility club may be constructed of any of the mentioned materials having a high modulus of elasticity, such as found in the low carbon steels and gray cast iron or higher. Such material will also have a relatively high hardness. The Brinell hardness of annealed ingot iron, which would be suitable, is approximately 69. Low carbon, nickel, silicon steels and hardened stainless steels have Brinell hardnesses which range approximately from 100 to 600, depending on how they are quenched or annealed. They are very suitable. In some cases, for manufacturing purposes, it is desired that they be machinable. Such machinable material is preferably one or more of the metals, alloys, metal mixtures and metal compounds, polymers and other materials enumerated above.

If the metal grip, say, a grip made of steel, is not covered by leather, rubber or the like, the grip never needs replacement. There is no deterioration of such a grip. Other grips which are comprised of leather, simulated leather, rubber, rubber-like compositions or various other resilient or cushioning compositions, will, sooner or later, deteriorate and have to be replaced.

It is preferred that the shaft extend substantially through or along the grip, say, to at least within 1" of the top end of the grip, that is, to 1" or less of the distal end of the grip from the head. In some embodiments, as discussed herein, the shaft extends the full length of the grip. In other embodiments, the shaft extends only partially within the grip.

The face of the head of the preferred embodiment, the putter, is generally flat, and is usually rounded at the corners and edges.

The face of the head of the golf club may be designed with a compound surface to correct for hitting the ball too far toward the toe or too far toward the heel of the putter. Such correction includes both correction of direction and correction of distance. The open heel and closed toe correct for direction when a missed hit, or hit outside the "sweet spot", occurs.

Loft, or slant angle of the face of a golf iron, determines the lift given to the ball. Greater loft, or slant angle, from the vertical, gives more lift to the ball and increases its roll.

It is, therefore, an object of this invention to provide a golf club which conveys a low frequency feel to the golfer when a ball is struck.

Another object of this invention is to provide one or more cavities between the grip and shaft of a golf club.

Yet Another object of this invention is to provide a golf club which conveys a sound of desired frequency to the golfer when a ball is struck.

And another object of this invention is provide golf club which conveys a high frequency sound to the golfer when a ball is struck.

Another object of this invention is to provide a golf club which provides little or no sound when a golf ball is struck.

Still another object of this invention is to provide a golf club which conveys a low frequency sound to the golfer when a ball is struck.

It is also an object of this invention to provide a grip having one or more cavities therein.

A still other object of this invention is to provide a golf club which provides a solid feel to the golfer's hands when a golf ball is struck.

It is another object of this invention to provide a golf club which has a grip having a high modulus of elasticity.

It is still another object of this invention to provide a putter which has a grip, shaft and head all having high modulus of elasticity.

Another object of this invention is to provide a putter whose grip, shaft and head are comprised of the same or similar materials having closely-related moduli of elasticity.

A further object of this invention is to provide a golf club which does not mask, dampen or distort the low frequency vibrations caused by the strike of the ball.

Further objects and features of the invention will become apparent from the following drawings and description.

DESCRIPTION

Figure 1:
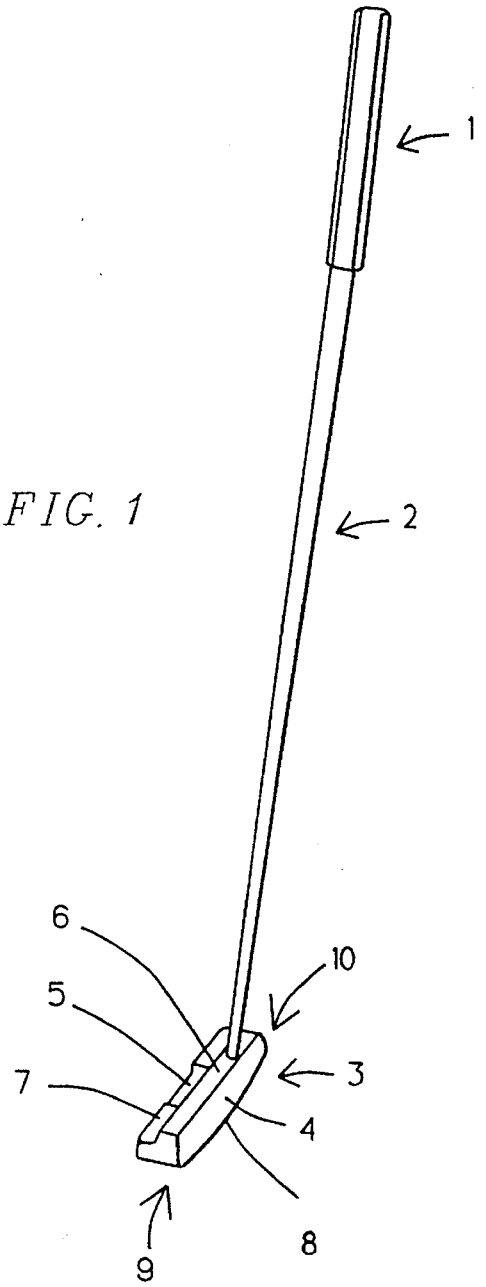
FIG. 1 is a golf club, a putter, showing grip, shaft and head.

In FIG. 1 is shown a golf club, a putter, comprised of a grip 1, a shaft 2 and head 3 having a face 4 and cavity 5. The golf club may be welded, cast, machined, forged or otherwise manufactured. Forging would likely be the most difficult, but advanced forging techniques are enabling the production of intricate shapes such as those described herein.

The golf club is preferably made of one or more of metals, alloys, metal compounds, or metal mixtures. Preferably, in a putter, all parts of the putter are preferably made of the same high modulus of elasticity material, which may be pure metal, alloy or other mixtures or compounds. In the irons, woods and utility clubs, the grip has a high modulus of elasticity, but the shaft will have substantially more flexibility, or "whippiness" than does the shaft of the putter. The heads of the irons, woods and playing utility clubs may be of a different material than the grip, but are, preferably, also, of high modulus of elasticity. In the putter, it is desired to have the shaft measure a stiffness of approximately 7.0 or greater on the Fuji Kura golf shaft frequency analyzer. The entire putter has such stiffness or greater. Stiffnesses to approximately 9.0 have been obtained. This stiffness of 7 and higher is substantially stiffer than prior putters which usually measure below 6.

The preferred method of manufacture is manufacture of grip, shaft and head individually, which are then welded, clamped, brazed, bonded, interference fit, soldered, fused, swaged, sweated, pinned, keyed or otherwise directly connected to each other. Glue, epoxy, silicon or similar materials may be used between the parts of the golf club, but should have great strength and the capability to withstand substantial shock caused by impact of the golf club against the golf ball. One preferred adhesive is an epoxy which cures in about 8 hours and is filled with a metal filler, such as brass or aluminum, which gives the epoxy a modulus of elasticity of approximately 100,000 psi or greater.

Combinations of manufacturing methods may be used. If the parts are "interference fitted", sometimes termed "friction fit" or "force fit", the parts are manufactured to close dimensions and tolerances and forced together. If the parts are pinned, a hole is drilled through the shaft and through the head or in the grip, as the case may be. A pin, having an interference fit to the drilled hole, is then driven through the head or grip and through the shaft. After peening the pin in place, the pin is ground and polished to the surface of the golf club so as to provide a smooth surface in which the pin is hard to detect. In keying the parts together, keyways in both parts, shaft and grip or shaft and head, are provided and one or more keys are inserted to hold the two parts firmly together. Clamping, or compressing, particularly of the grip to the shaft, has also been found suitable. Care must be taken not to disfigure or distort the shape of the shaft, otherwise its structural integrity will not be retained.

Connections between grip and shaft or shaft and head, using epoxy, glue or similar intervening material may be made. Such materials are better if they contain a strengthening or hard filler.

The shaft is firmly connected to the grip, in the preferred embodiment, by two collars, or sleeves. Preferably, such collars, or sleeves, are made of metal similar in modulus of elasticity to the grip and shaft. Interference fit, welding, brazing, soldering and so forth, mentioned above, may be used to connect shaft and grip to the collars and sleeves. The epoxys and adhesives may also be used, if desired. The open, upper end of the shaft may be expanded to fit the collar or sleeve, by a plug driven into the upper end of the shaft. The same is true of the fit to the head, wherein a plug may be inserted into the shaft from the bottom of the head to complete or strengthen the interference fit of the shaft to the head. This, in effect, is a form of swaging which is, of course, a suitable direct connection method. If the plug is made of wood, a screw may be screwed into the wooden plug to tighten the shaft against the head.

In the putter, a stiff, True Temper, untapered, shaft of low carbon steel having an outer diameter of 0.380"±0.060" is preferred. Such outer diameter allows, say, 3/16" clearance between the shaft and the inner diameter of a grip. A grip might have, for example, a 1" outer diameter and a wall thickness of 1/8" or, preferably, greater, such as 1/8". Such clearance between the shaft 2 and the grip 1 provides the cavities within the grip. Such shafts are likely to have a wall thickness of 0.030" to 0.060". Of course, a stronger metal such as titanium could have much thinner walls than such grip wall thickness and such shaft thicknesses.

Tapered shafts may be used provided suitable clearance at the grip end can be obtained. Fluted shafts may also be used. Such shafts may be obtained from True Temper Sports Division, 871 Ridgeway Loop Road, Suite 201, Memphis, Tenn. 38120-4066. There is a wide range of sources for golf shafts. These sources are known to those skilled in the art of making golf clubs.

It has been found that closing the ends of the shaft, with plugs, provides more feeling in the hands and helps to reduce the high frequencies and harmonics from the feeling in the hands. Also, it enhances the low frequency sounds.

Various coatings or surface treatment of the grip, the shaft or the head may be applied, such as, but not limited to, chrome, anodize, hardening, knurling, bead blasting, groove-cutting, sanding, etching or other coating or surface treatment which does not interfere with the structural integrity of the golf club.

Plating the entire club, as a unit after it is assembled, provides a better feel and helps to remove high frequencies and mid-range frequencies which are not desired to be felt. Chrome, nickel, cadmium, zinc or other non-corrosive platings are suitable. A flexible or resilient grip may be added to the grip after such plating.

The shaft of the putter, when made of a low carbon steel, is preferably about 0.4" outer diameter at its lower end, where it is connected to the head. In one embodiment, the hole in the head, which receives the shaft, is manufactured by drilling the hole to 0.369" and reaming it to 0.371". A shaft of 0.370 is then inserted. Dimensions of many shafts at their lower ends are likely to be within ±0.02" of those just mentioned. In the putter, the shaft may, in some embodiments, suitably be held by interference fit. However in the irons and woods, additional strength is needed, therefore, the shaft should also be pinned to the head or hosel or strengthened by other means. A cross-pin running through the hosel and shaft, from the front side toward the green when playing, to the back side away from the green is usually used. Wrapping of the hosel and a short portion of the shaft with a 60 or 80 pound fishing line, Nylon line or other strong, tough line, is another means for strengthening the shaft-to-head connection in the irons and woods.

The shaft wall thickness is approximately 0.03". Of course, it is to be realized that differing materials may have greater or less outer diameter and wall thickness because of the strength and modulus of elasticity of the particular material or materials used. The desired stiff feel of the putter requires a greater outer diameter, greater wall thickness or both, if the modulus of elasticity of the shaft material is less. The desired stiff feel requires less outer diameter and wall thickness, if the modulus of elasticity of the shaft material is greater.

Fluted shafts, or shafts having fluted portions may be used in the putter, inasmuch as the fluted portions are 10–15% stronger than unfluted portions. Therefore, fluted shafts may be somewhat smaller than unfluted shafts in outer diameter and wall thickness. Malleable cast iron, annealed ingot iron, and commercial wrought iron may be used because they have a modulus of elasticity fairly close to that of low carbon steels. Alloy steels, including nickel steel, chrome-nickel, chrome-vanadium, molybdenum and others, may be used in the putter inasmuch as their modulus of elasticity is approximately the same or greater than that of the low carbon steels. The strength and stiffness of such alloy steels and other alloys are often determined by their heat treatment rather than their composition.

The golf club preferably has a balance point within approximately 3" of midway between the top and bottom ends of the club. This is achieved mostly by increasing or decreasing the grip weight. The grip outer diameter and length may be varied as may the thickness of the grip wall. This helps to provide a solid feeling when striking the ball. In the putter, the shaft may be, for example, 35" long and the balance point would be approximately 17.5" from either end.

FIG. 1 shows shaft 2 entering head 3 through a hole in the top surface 6. The top surface 6 may be approximately 0.4" wide. If, then, the hole for the shaft is 0.37", there is approximately a 0.015" wall on each side of the hole 7, if it is centered in the top surface 6. Other constructions are possible, but those dimensions are preferred, for a hosel-free connection to the head. For example, the hole in the head may be as wide or wider than top surface 6. The hole may be located a bit to the rear of top surface 6 and, thus, not centered, in top surface 6. This allows the user to see the entire face of the putter and adds minor offset without bending the shaft. That is not as aesthetically pleasing but, nevertheless, is very suitable functionally. The hole should not extend into the front Face 4 of the putter head 3.

A hosel may be used to connect the head to the shaft. Numerous hosel constructions, which are commonly made a part of the head, are known to those skilled in the art and available on the market. Some of such hosel constructions place the shaft forward or rearward of the face of the golf club, more toward the heel or the toe of the golf club and place the shaft at various angles to the head.

In FIG. 1, cavity 5 is disposed in valley 7 of the head 3. Cavity 5 adds to the feel and sound of the putter.

As shown in FIG. 1, the face 4 is flat with slightly rounded corners and edges at the toe 9, heel 10 and foot 8. In the putter, the face 4 has a loft, or backward slant, of approximately 2 degrees to 4 degrees, depending on the golfer's preference. The foot 8, where the putter head 3 meets the grass, is rounded to approximately ¼" radius to prevent the head 3 from "sticking" or digging into the grass or ground. The foot 8 is an arc from toe 9 to heel 10 having approximately a 20" radius.

Figure 2:
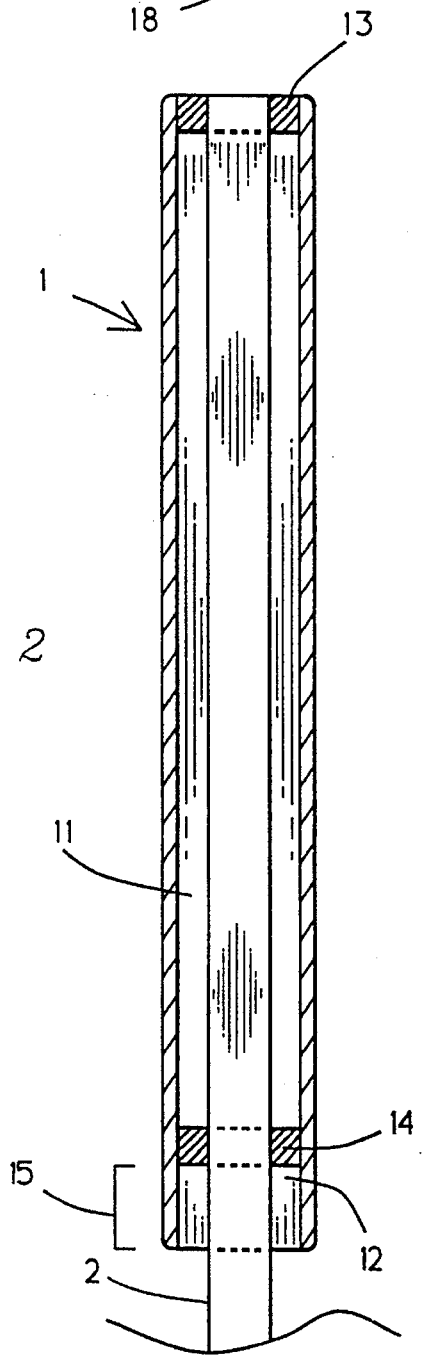
FIG. 2 is a cross-section of the grip showing the shaft extending throughout the length of the grip and a collar located at or near each end of the grip.

FIG. 2 is a partial cross-section of the body of a grip 1 which maintains and enhances the low frequency vibrations which are felt and maintains and enhances the high frequency vibrations which are heard. Theoretically, it is believed that the structure of the grip and its connection to the shaft, either dissipates and reduces the mid-range frequency vibrations and high frequency vibrations, or overwhelms such vibrations with low frequency vibrations, so that the mid-range and high frequency vibrations are not transmitted through the grip to the golfer's hands. Such dissipation, reduction and overwhelming mid-range and high frequency vibrations are termed hereafter as "concealed" mid-range and high frequency vibrations. The volume of air trapped within the cavity 11 and the length of cavity 11 enhance the low frequency vibrations felt in the grip 1. The low frequency feel which is generated may be adjusted from below 20 cycles per second to 40 cycles per second or greater, by reducing the length of the cavity 11.

The shaft 2, which is shown in relief, extends within the grip 1, shown in cross-section, forming two cavities 11 and 12 between shaft 2 and the inner wall of grip 1. Collar 13 is located at the top of the grip 1 and extends around shaft 2, mounting it firmly in place within grip 1. Collar 14 is fitted toward the lower end of grip 1 and also extends around shaft 2, mounting it firmly within grip 1. Collar 14 is constructed and fitted in the same manner as collar 13. Collars 13 and 14 are preferably metal or other high modulus of elasticity material connecting the shaft to the grip.

Such collars 13 and 14 provide additional walls which, together with the inner wall of grip 1 and the outer wall of shaft 2, complete the closure of cavity 11. Cavity 11 may be as short as ¼" or as long as the full length of the grip. A preferred length of cavity 11 is approximately 4" to 10".

Collar 14 also provides a wall which, together with the inner wall of grip 1 and the outer wall of shaft 2, create a cavity 12 at the end of grip 1. The collars 13 and 14 are connected to grip 1 and shaft 2 by any of the means previously mentioned, by being welded, clamped, brazed, bonded, interference fit, soldered, fused, swaged, sweated, pinned, keyed or otherwise directly connected.

Combinations of such direct connection methods may be used. It has been found that epoxies and other adhesives commonly use in golf club assembly, may also be used. It is preferred, but not absolutely necessary, that such epoxies or adhesives be filled with material that gives them greater modulus of elasticity than otherwise.

It is believed that the mid-frequencies, both as to feel, (vibration), and sound, are absorbed and disappear, that is, concealed, because of the collars 13 and 14, because of the long cavity within the grip and because of the grip having a high modulus of elasticity.

Grip lengths range approximately from 8" to 10". In a preferred embodiment, the outer diameter of the grip, is 1" and the inner diameter is ¾". The collars 13 and 14 may have just under a ¾" outer diameter in order to fit within the inner diameter of grip 1. Collars 13 and 14 may have an inner diameter of slightly larger than ⅜". Thus, they can receive a⅜" shaft. Collars 13 and 14 are preferably from ¼" to ½" thick, but may be thicker, or longer. In that case, collars 13 and 14 might more properly be called sleeves. Steel collars thinner than ¼" bend somewhat when the shaft vibrates as the ball is hit and do not provide sufficient structural strength to properly connect the shaft to the grip. Such collars 13 and 14 provide additional weight in the grip, to help place the balance point of the golf club approximately midway along the shaft as discussed previously. Collars 13 and 14 also help to diffuse high Frequency vibrations and keep them from being felt in the golfer's hands. Enclosed cavity 11 maintains and enhances the low frequency vibrations which are felt in the golfer's hands. Also, cavity 11 is believed responsible for concealing the mid-range and high frequency vibrations created upon striking the golf ball, Partially-enclosed, or open, cavity 12 is a resonant cavity which provides high frequency sound, for those who desire to hear it. Length 15 may vary from approximately 1/16" to 3" in order to produce the high frequency sound at a frequency desired by the golfer. By decreasing the length 15 of the cavity 12, the high frequency tone can be increased to a higher, desired frequency. As the cavity 12 is made longer, the high frequency which is heard becomes lower and of greater loudness.

If collar 14 is placed farther than approximately 3" from the end of grip 1, it will cause the shaft 2 to undesirably "buzz" against grip 1, upon a hard strike, because of the flexing of shaft 2.

Figure 5:
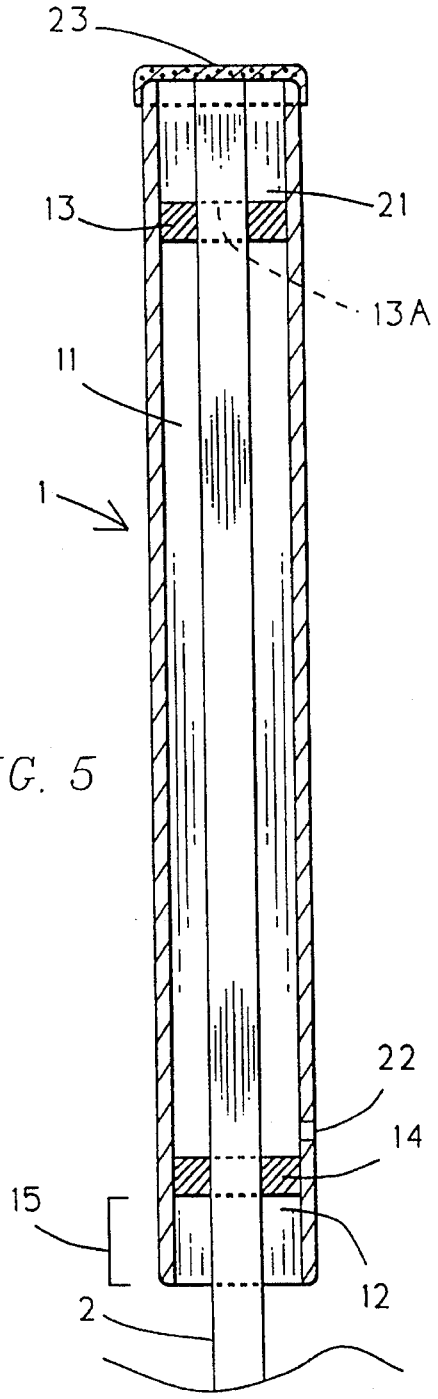
FIG. 5 is a cross-section of the grip showing the shaft extending throughout the length of the grip and both collars located a short distance from the ends of the grip.

It is to be appreciated that the grip 1 could be reversed with the cavity 12 on the upper end of grip 1, as discussed hereafter in connection with FIG. 5, but that is not so effective and cavity 12 does not then provide the clear, high frequency sound it provides when it is at the lower end of the grip 1.

Figure 3:
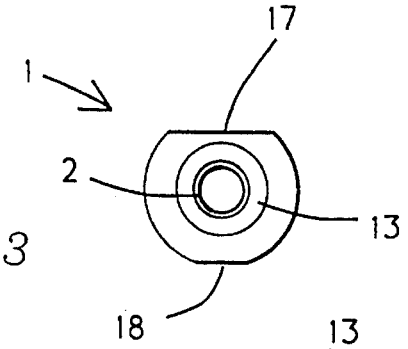
FIG. 3 is an end view of the grip, showing one of the possible shapes of the grip.

FIG. 3 is an end view of the grip of FIG. 2. Shaft 2 is disposed within grip 1 and is surrounded by collar 13. A preferred shape of the grip 1 includes flat surface 17 and flat surface 18 which shape gives the golfer good control of the grip. In a grip having a 1" outer diameter, flat surface 17, the top of the grip, receiving the thumbs, may be, for example, approximately 0.7" long. Flat surface 18, the bottom of the grip, may be, for example, approximately 0.25" long. Such surfaces might be approximately 0.88" apart.

Figure 4:
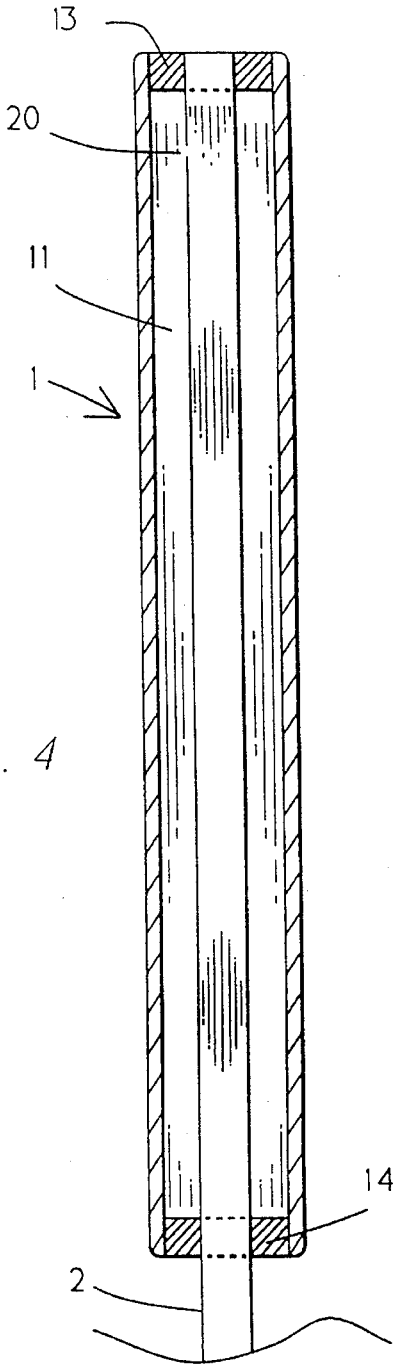
FIG. 4 is a cross-section of the grip showing the shaft extending throughout the length of the grip and a collar at each end of the grip.

FIG. 4 is a partial cross-section of the body of a grip 1 having a single cavity 11. This embodiment would provide no high frequency sound or feel. Shaft 2 extends throughout the length of grip 1. Cavity 11 extends from one end of grip 1 to the other. That is, collars 13 and 14 are located at respective ends of the grip 1, creating a single cavity 11. Vent 37 is an air pressure relief hole and is disposed in shaft 2 to prevent cavity 11 from being affected due to change in altitude causing change between air pressure inside and outside the cavity 11. Such vent 37 may be a slot. Vent 37 would be small, say, 0.03" in diameter. FIG. 4 provides a lower frequency feel in the grip. High frequency sounds do not exist or are only weakly heard from such embodiment.

FIG. 5 is a partial cross-section of the body of grip 1 in which shaft 2 extends throughout the length of the grip. The grip has a partially-enclosed cavity 21 at the top and a partially-enclosed cavity 12 at the bottom of the grip 1. Collars 13 and 14 are each shown as being located a short distance from the ends of grip 1. Again, such collars 13 and 14 may be spaced from 1/16" to 3" from the ends of the grip. It is noted that vent 22 is disposed in the wall of grip 1. Also, a cap 23, which may be porous, foam rubber, a screen or other porous material may or may not be utilized to cover the top cavity 21 to keep out the dirt. It is to be appreciated that shaft 2 may terminate at collar 13, as shown by dotted line 13A.

Figure 6:
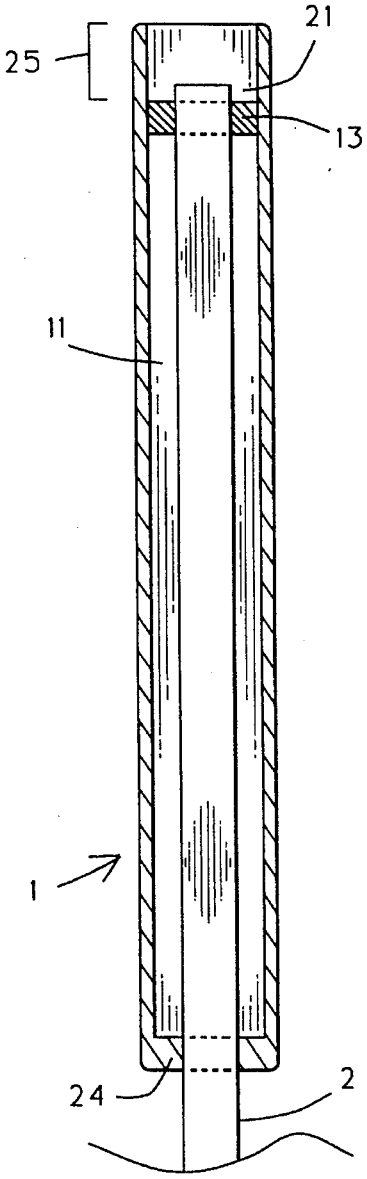
FIG. 6 is a cross-section of the grip showing the grip wall forming one of the collars for mounting the shaft.
Figure 7:
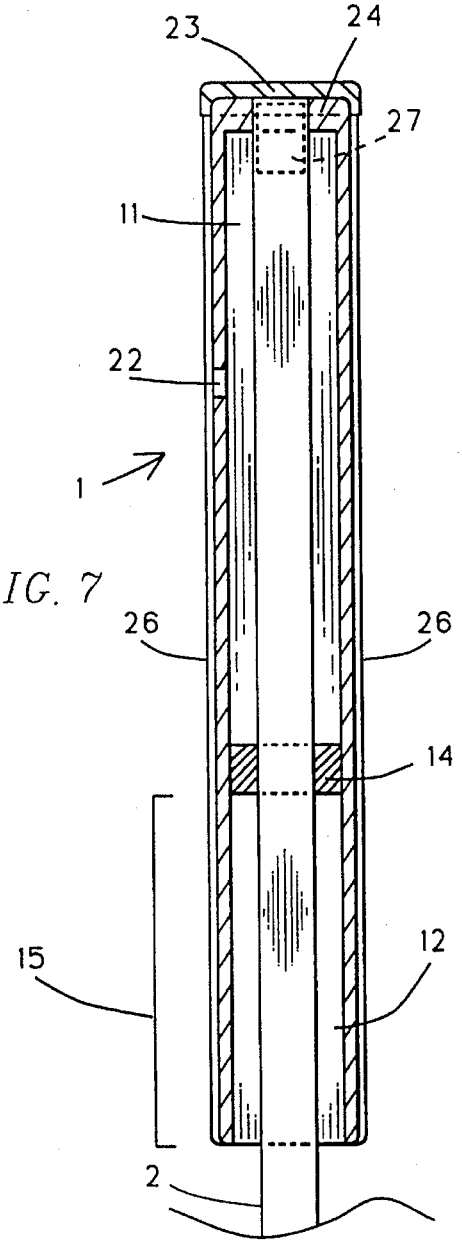
FIG. 7 is a cross-section of the grip showing the grip wall forming one of the collars for mounting the shaft and, also, showing a cap and thin covering on the grip, and a plug in the end of the shaft.

FIG. 6 is a cross-section of the grip 1 showing the grip wall portion 24 forming one of the collars for mounting the shaft 2. Collar 13 is located a distance 25 from the end of the grip 1, forming cavity 21 at tile top end of grip 1. Shaft 2 ends slightly beyond shaft 13. Enclosed cavity 11 extends from the bottom of the grip to collar 13. Shaft 2 may or may not be plugged at one or both ends. The low-frequency resonance of the golf club is improved by plugging both ends of the shaft. An air pressure relief hole may be disposed in shaft 2 to prevent cavity 11 from being affected due to change in altitude causing change between air pressure inside and outside the cavity 11. Such vent may be a slot. The vent would be small, say, 0.03" in diameter. It may be desirable to slightly reduce the thickness of the grip wall so that the grip does not become too large in diameter when the covering 26 is added. A plug 27 may or may not be included in the end of the shaft 2. The grip wall portion 24 forms the top collar, connecting the shaft 2 to grip 1. Bottom collar 14 also connects shaft 2 to grip 1. It is noted that collar 14 is disposed at distance 15 from the bottom end of the grip. If the grip 1 is considered to be 9" long, such distance 15 is shown as being about 3", which is approximately the maximum desirable distance. The shaft 2 will chatter, or "buzz", against the wall of the grip 1 if such distance 15 is much greater than 3".

The collar 14 is shown as being approximately ½" in thickness. vent 22 is disposed in the wall of grip 1. In this embodiment, cavity 12 provides the lowest of the high frequency sounds to the golfer, by reason of its being about as long, or deep, as it can be.

Figure 8:
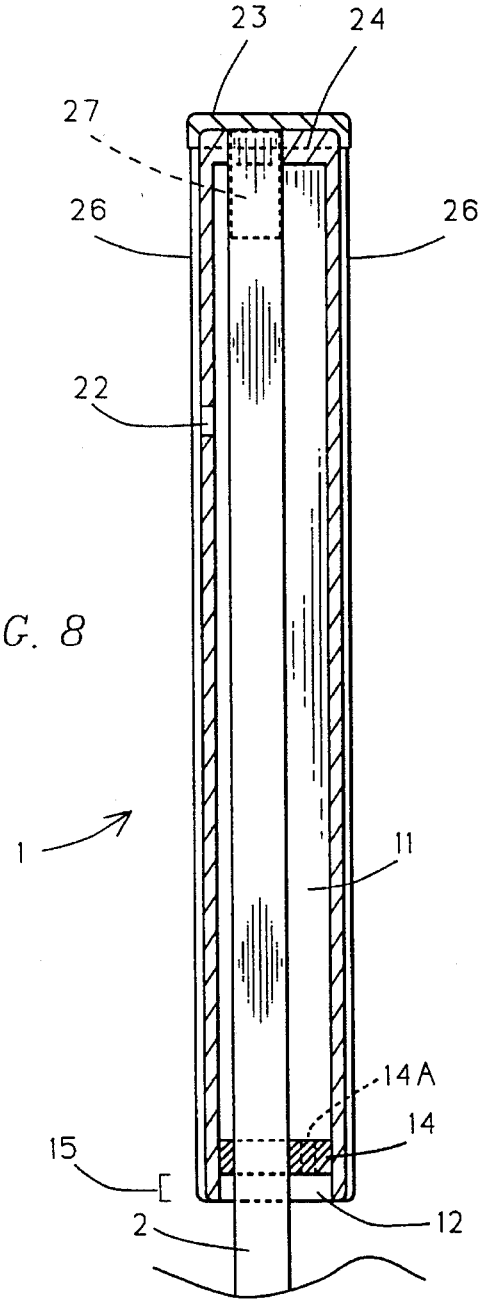
FIG. 8 is a cross-section of the grip showing the shaft mounted eccentrically within the grip.

FIG. 8 is a cross-section of the grip 1 showing the shaft 2 mounted eccentrically within the grip 1. Cavity 11 is wider on one side of shaft 2 than on the other. This feature provides a cavity 11 of wider space although the total cubic inches of cavity 11 remains the same as in those embodiments in which the shaft is concentrically-mounted within the grip. The top collar of the cavity 11 is provided by the wall portion 24 of the grip 1. The bottom collar 14 is disposed near the bottom end of grip 1. Thus, a very small cavity 12 is provided and the sound that is heard will be of very high frequency and it will be of low dB, or intensity. A cap 23 is shown. Such cap may or may not be used. A plug 27 may be inserted in the end of shaft 2, and in the opposite end of shaft 2, to improve the low frequency resonance of the golf club. Covering 26 covers grip 1. Vent 22 is shown in the grip wall underneath the covering 26. It may be seen that collar 14 is eccentrically located around shaft 2.

It may be desirable to provide communicating channels from cavity 11 to cavity 12, to obtain desired frequency effects. In order to accomplish this, collar 14 may have one or more holes drilled there-through, as shown, for example, by dotted lines 14A. If desired, the other collar 24, or collar 13 in FIGS. 2, 4, 5 and 6, may have one or more holes drilled therethrough. Alternatively, or in conjunction with such holes, collars 14, 13 or 24, or any combination thereof, may have depressions in their circumferences, to provide channels from cavity 11 to the outside or to cavity 12.

Figure 9:
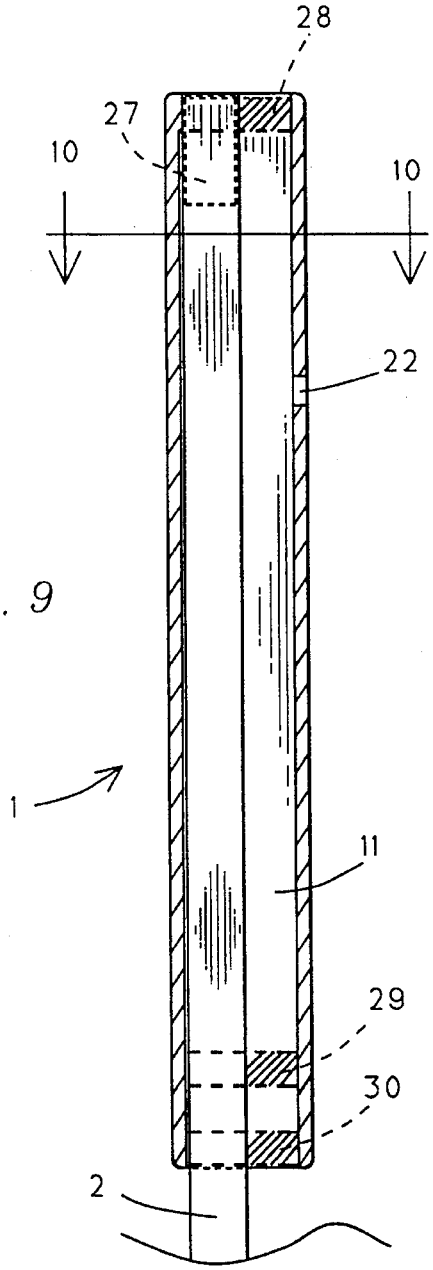
FIG. 9 is a cross-section of the grip showing the shaft attached or abutting the inner wall of the grip.

FIG. 9 is a cross-section of the grip 1 showing the shaft 2 attached to or abutting the inner wall of the grip 1. Shaft 2 may be attached to the grip 1 by welding, brazing, soldering, bonding, etc., or through the use of adhesives which are able to take a great deal of impact. On the other hand, shaft 2 may not be attached to the grip, but merely abut the grip, being firmly fixed with respect to the grip by collars located at positions 28, 29 and 30. Eccentric mounting of the shaft, as shown in FIG. 9, achieves a wide cavity 11. Barriers may be placed at locations 28, 29 and 30 at the top and bottom end of the grip 1 such as shown in dotted lines. The barriers 28, 29 and 30 may be constructed of the same material as the collars 13 and 14 in prior Figs., or may be of less stiff material, but still of a material hard enough to reflect sound, vibrational waves between them and to carry vibrations to be felt. Enclosed cavity 11 lies between barriers 28 and 29 or 30. Such barriers may be of less thickness than ¼" because they would carry little or no structural load. It may be seen that collars, or barriers, 28, 29 and 30 are crescents and do not entirely encircle shaft 2.

Figure 10:
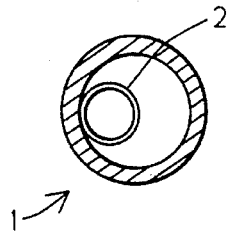
FIG. 10 is a cross-section of a top view of the grip taken on line 10—10 of FIG. 9, showing the shaft attached to or abutting the inner wall of the grip.

FIG. 10 is a full, cross-section view of the grip 1 of FIG. 9, taken on line 10—10. It shows the shaft 2 attached to the inner wall of the grip 1. As may be seen, such construction obtains the widest space between shaft and grip, to form cavity 11. The cubic inches within cavity 11 remain the same irrespective of where within the grip the shaft is located, provided the shaft runs the entire length of the grip.

Figure 10A:
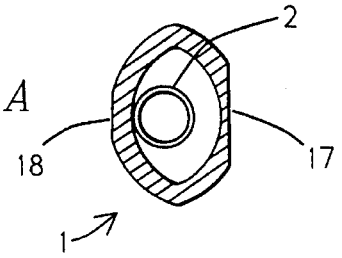
FIG. 10A is a cross-section of a top view of an elliptical grip having flat surfaces for the golfer's grip.

FIG. 10A is a cross-section of a top view of an elliptical grip 1 having flat surface 17 to receive the golfer's thumbs. Flat surface 18 also aids the golfer's grip. Preferably, the outer diameter of the grip is approximately 1¼" or less. It is to be appreciated that the top view of the grip could be square, rectangular, rhomboidal, frapezoidal, hexagonal or of other multi-sided configuration.

Figure 11:
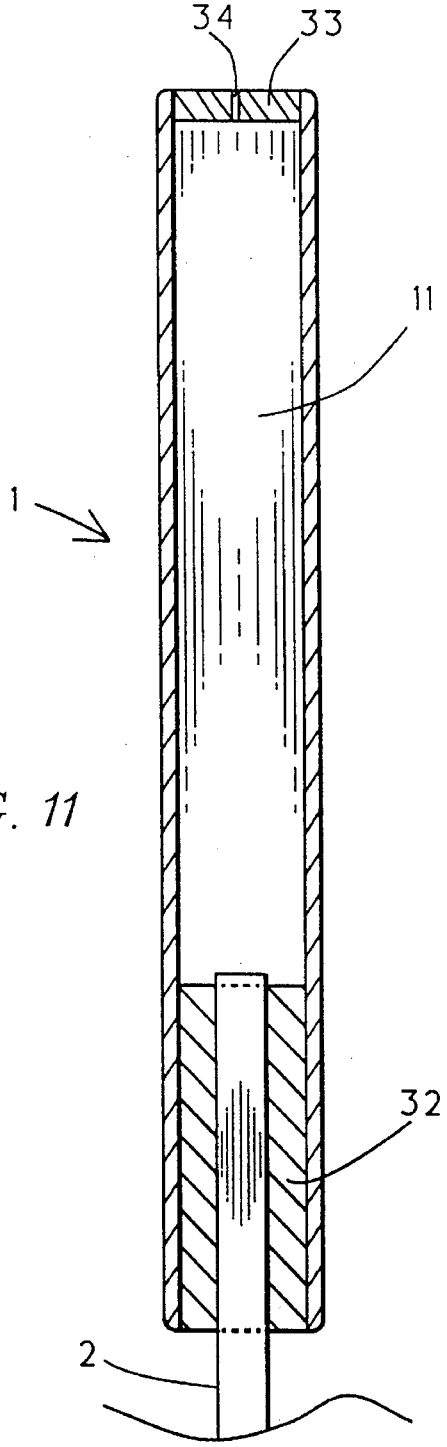
FIG. 11 is a cross-section of the grip showing the shaft attached to the grip by a sleeve, with the end of the shaft near the end of the sleeve.

FIG. 11 is a partial cross-section view of the grip 1 showing the shaft 2 attached to the grip 1 by a sleeve, or collar, 32. Barrier 33 encloses the top end of grip 1 and is constructed similarly to barriers 28 and 29 of FIG. 9, because it carries little or no load. Barrier 33 has vent 34 to allow air pressure inside the grip to equalize with the atmosphere. In FIG. 11 the shaft 2 terminates at or near the end of the sleeve, or collar, 32. Sleeve 32, if a single sleeve is used, is approximately 0.4" to 4" long, sufficient to firmly connect shaft 2 to grip 1. If two sleeves are used, one at or near the top of the grip and the other at or near the bottom of the grip, or either one at some intermediate location, such sleeves may be substantially thinner and be of the width of collars 13 and 14 described previously. The cavity 11 is slightly larger in cubic inches, if constructed in this manner, and lower frequency vibrations in the grip should be attainable. However, cavity 11 is made shorter because of the length of sleeve 32.

Figure 12:
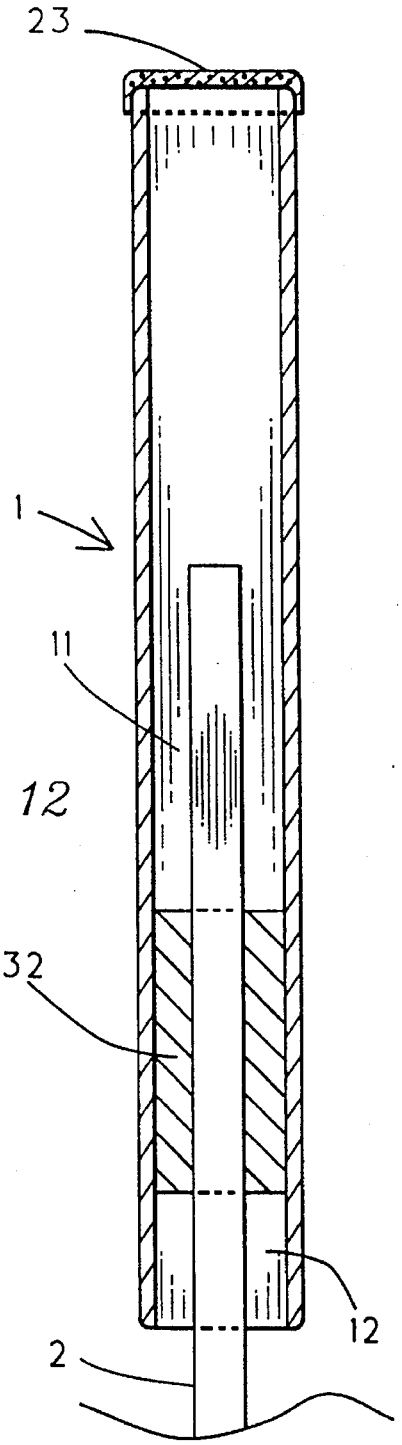
FIG. 12 is a cross-section of the grip showing the shaft attached to the grip by a sleeve located a short distance from the end of the grip and the shaft extending beyond the sleeve.

FIG. 12 is a cross-section of the grip 1 showing the shaft 2 attached to the grip 1 by a sleeve, or collar, 32 located a short distance from the end of the grip 1 and the shaft 2 extending into the grip 1 beyond the sleeve 32. This construction creates both a low frequency cavity 11 and high-frequency cavity 12. The shaft 2, extending into cavity 11, provides a better source for the sounds enhanced in cavity 11. Cap 23, made of leather, rubber, rubber composition, or a porous material may or may not be used.

Figure 13:
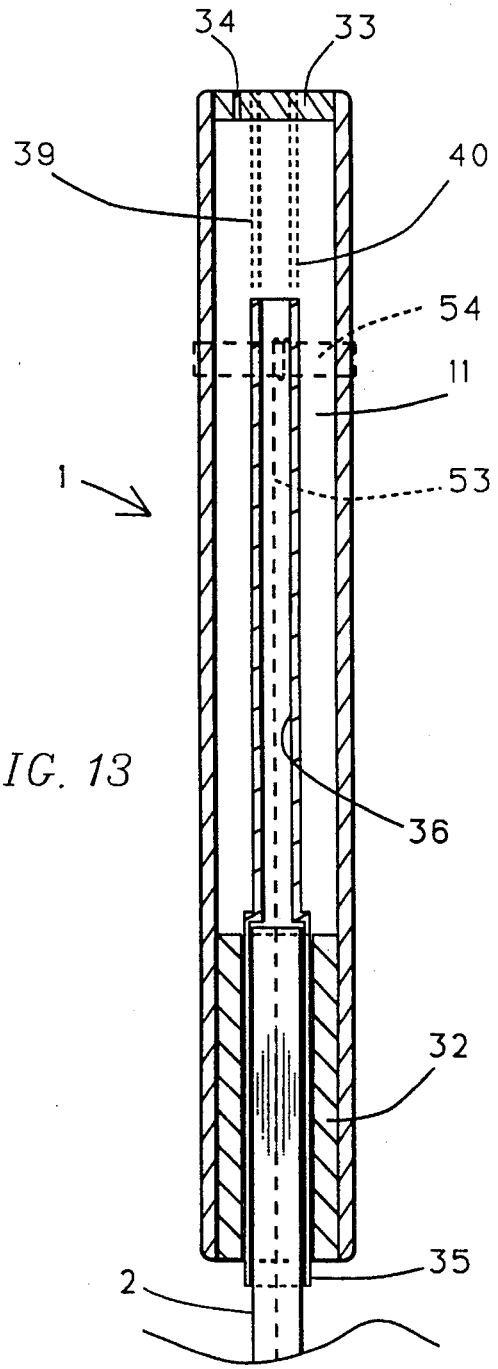
FIG. 13 is a cross-section of the grip showing the shaft inserted into a sleeve providing an extension to the shaft.
Figure 14:
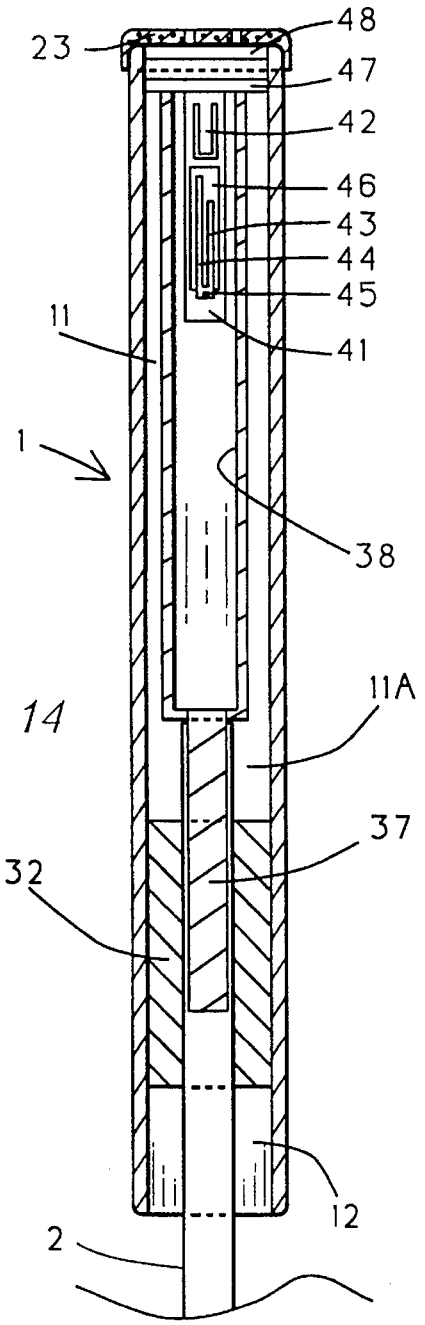
FIG. 14 is a cross-section of the grip showing the shaft receiving an insert from an extension of the shaft and a vibrating element having reeds.

Notwithstanding the illustrations of FIGS. 11 and 12, it is believed the U.S.G.A. requires shafts to extend close to the top of the grip. FIGS. 13 and 14 illustrate how such may be accomplished by using extensions.

FIG. 13 is a cross-section of the grip 1 showing the shaft 2 inserted into a sleeve 35 providing an extension 36 to the shaft 2. Shaft extension 36 may be closely fitted to the inner diameter of grip 1, still leaving a narrow cavity therebetween, or shaft extension 36 may be substantially smaller than the inner diameter of grip 1 and thereby create a larger cavity between it and the inner diameter of grip 1. A cavity of no less than approximately 1/32" in width is desirable. Cavities having smaller widths than 1/32" may be used if the shaft 2 can be kept from chattering against the inner wall of grip 1.

The wall of shaft extension 36 may extend closer to the top end of the grip 1, or even into the barrier 33 at the top of the grip, as shown by dotted lines 39 and 40. As shown, shaft extension 36 may be smaller in diameter than the shaft 2 and thus create a wider cavity 11 between grip I and shaft 2 than otherwise possible.

In FIG. 13 is shown an alternate embodiment in dotted lines, comprised of vibrating, tuned string 53, tuning peg 54 around which string 53 is wound for tuning. Tuned string 53 is anchored, say, at or near the bottom of the shaft 2. Tuning peg 54 is accessible from exterior of the golf club in order to tune and maintain the tuning of string 53. Tuning peg 54 may protrude slightly, may be flush with, or may be recessed in grip 1. As may be appreciated, although string 53 extends within shaft 2, tuning peg 54 may be more accessibly mounted above the end of shaft 2, in grip 1.

FIG. 14 is a cross-section of the grip 1 showing the shaft 2 receiving an insert 37 from shaft extension 38 of the shaft 2. As with the embodiment of FIG. 13, shaft extension 38 may be small or large in diameter to form the cavity 11 between it and the inner diameter of the grip 1. It is noted that another cavity 11A may be formed between shaft extension 38 and the sleeve 32. Thus, three cavities are formed.

It is noted in FIG. 14 that a vibrating element 41 may be included within the extension 38 of shaft 2. It may also be located within shaft 2 proper. Vibrating element 41 is fixedly connected to a disc-like cap 47 which is shown mounted on the end of the extension 38 of shaft 2. Vibrating element 41 may be mounted in other ways inside extension 38 or within shaft 2 proper. Of course, vibrating element 41 may be much more elongated than shown. It may be in the form of a thin blade or it may be in the form of a rod or other shape, which will vibrate readily. Also, vibrating element 41 may be mounted at the other end of shaft 2, at or near the head, or at some intermediate position along shaft 2. Also, it may be inverted from the position shown.

One embodiment is to provide element 41 with vibrating reeds, such as reeds 42, 43 and 44. Reeds 43 and 44 are shown as riveted to vibrating element 41. Such reeds may be constructed as they are, say, in a harmonica. In this embodiment, vibrating element 41 may or may not be constructed so as to also vibrate. The reeds may be constructed out of the material of vibrating element 41, as shown by reed 42 or the reeds may be constructed and connected to vibrating element 41 by being riveted, welded, soldered or otherwise attached thereto. A desired tone or tones may be obtained by adjustment of the length and stiffness of the reeds, much the same as in a harmonica, or a tuning fork. Also, beat notes can be obtained at desired frequencies by the sum and difference frequencies of two or more reeds, such as reeds 42 and 43, or two or more vibrating elements 41, within the shaft 2 of a golf club.

If desired, an electronic amplification circuit 48 may be installed in the golf club.

Figure 15:
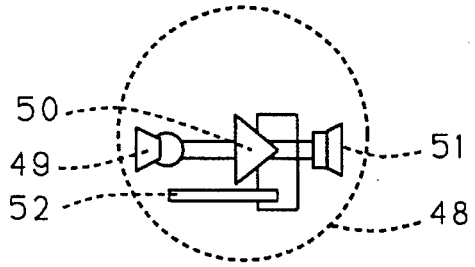
FIG. 15 is an electrical schematic of a microphone pickup, amplifier and loudspeaker for providing sound in a golf club.

FIG. 15 is an electrical schematic of amplification circuit 48, comprised of microphone pickup 49, amplifier 50 and loudspeaker 51 for providing sound in a golf club. It may be seen in FIG. 14 how the electrical circuit may be physically disposed. Of course, various other well-known sound amplification circuits may be employed.

Figure 15A:
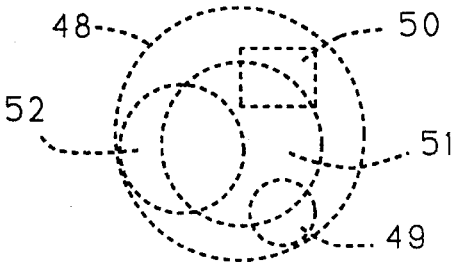
FIG. 15A is a physical layout of the electrical components of the schematic of FIG. 15.

FIG. 15A is one embodiment of the physical layout of the electrical components of the schematic of the amplification circuit 48 of FIG. 15. As may be seen, the loudspeaker 51 may overlie all such components, with battery 52 lying to one side underneath loudspeaker 51, the microphone 49 lying to another side underneath loudspeaker 51 and the amplifier 50 or other electronics disposed as shown.

A golf club constructed as set forth herein has been found to provide better feel and sound to the golfer. Connecting the grip to the shaft in the manner taught, adds to and enhances the low frequency feel and sound, if desired by the golfer, at a frequency preferable to him.

The preferred embodiment of the invention, a putter, constructed as set forth herein has been found to provide the golfer with a low frequency feel having a vibrational intensity several times that of prior putters. This is particularly true in the case of a correct hit, that is, a hit within the "sweet spot" area.

A set of golf clubs having related vibrational, (feel), and sound qualities may be obtained by using the invention described herein. The matching may be in the set of clubs having closely similar qualities or in uniformly-varying or non-uniformly-varying qualities of vibration or sound, or both, from the putter through all, or some of, the other clubs to the driver.

Although specific embodiments and certain arrangements have been illustrated and described herein, it will be clear to those skilled in the art that various modifications and embodiments may be made incorporating the spirit and scope of the underlying inventive concepts and that the same are not limited to the particular examples herein shown and described except insofar as indicated by the scope or the appended claims.

I claim:

1. A playing golf club comprising a grip, a shaft and a head, said head having a face for striking a golf ball, said shaft having opposite ends, said grip connected to one of said ends and said head connected to the other of said ends, and wherein said shaft extends a substantial distance within said grip and wherein is included one or more cavities between the inside of said grip and said shaft and wherein said grip is connected to said shaft by first and second connection means between said shaft and the inside of said grip, said first and second connection means being disposed apart thereby creating said one or more cavities inside said grip and wherein said one or more cavities comprise one enclosed cavity and one open cavity and wherein said open cavity is substantially shorter in length than said enclosed cavity.

2. The playing golf club of claim 1 wherein said open cavity is approximately 3" or less in length.

3. The playing golf club of claim 2 wherein said open cavity is at the end of said grip nearest said head.

4. The playing golf club of claim 1 wherein said enclosed cavity between said first and second connection means is vented.

5. A playing golf club comprising a grip, a shaft and a head, said head having a face for striking a golf ball, said shaft having opposite ends, said grip connected to one of said ends and said head connected to the other of said ends, and wherein said shaft extends a substantial distance within said grip and wherein is included one or more cavities between the inside of said grip and said shaft and wherein said grip is connected to said shaft by first and second connection means between said shaft and the inside of said grip, said first and second connection means being disposed apart thereby creating said one or more cavities inside said grip and wherein said grip and one or more of said first and second connection means are substantially comprised of one or more materials having a modulus of elasticity substantially greater than 2,000,000 psi.

6. A playing golf club comprising a grip, a shaft and a head, said head having a face for striking a golf ball, said shaft having opposite ends, said grip connected to one of said ends and said head connected to the other of said ends, and wherein said shaft extends a substantial distance within said grip and wherein is included one or more cavities between the inside of said grip and said shaft and wherein said grip is connected to said shaft by first and second connection means between said shaft and the inside of said grip, said first and second connection means being disposed apart thereby creating said one or more cavities inside said grip and wherein said first and second connection means connecting said grip and said shaft are adhered to said grip and said shaft by an adhesive material having a modulus of elasticity of approximately 100,000 psi or greater.

7. A playing golf club comprising a grip, a shaft and a head, said head having a face for striking a golf ball, said shaft having opposite ends, said grip connected to one of said ends and said head connected to the other of said ends, and wherein said shaft extends a substantial distance within said grip and wherein is included one or more cavities between the inside of said grip and said shaft and wherein said grip is connected to said shaft by first and second connection means between said shaft and the inside of said grip, said first and second connection means being disposed apart thereby creating said one or more cavities inside said grip and wherein said first and second connection means comprise two collars disposed on said shaft between said shaft and said grip, said collars being approximately 4" or more apart and wherein one of said cavities is enclosed and extends from one of said collars to the other and wherein said two collars are constructed of material having a modulus of elasticity substantially greater than 2,000,000 psi.

8. A playing golf club comprising a grip, a shaft and a head, said head having a face for striking a golf ball, said shaft having opposite ends, said grip connected to one of said ends and said head connected to the other of said ends, and wherein said shaft extends a substantial distance within said grip and wherein is included one or more cavities between the inside of said grip and said shaft and wherein said grip is connected to said shaft by first and second connection means between said shaft and the inside of said grip, said first and second connection means being disposed apart thereby creating said one or more cavities inside said grip and wherein said first and second connection means comprise two collars disposed on said shaft between said shaft and said grip, said collars being approximately 4" or more apart and wherein one of said cavities is enclosed and extends from one of said collars to the other and wherein said grip has opposing ends and one of said collars is disposed from approximately 1/16" to approximately 3" from one of said ends of said grip, thereby forming an open cavity at said one end of said grip.

9. A playing golf club comprising a grip, a shaft and a head, said head having a face for striking a golf ball, said shaft having opposite ends, said grip connected to one of said ends and said head connected to the other of said ends, and wherein said shaft extends a substantial distance within said grip and wherein is included one or more cavities between the inside of said grip and said shaft and wherein said grip is connected to said shaft by first and second connection means between said shaft and the inside of said grip, said first and second connection means being disposed apart thereby creating said one or more cavities inside said grip and wherein said grip has a longitudinal, inner wall and wherein said shaft is disposed in contact with said longitudinal, inner wall of said grip for substantially the distance between said first and second connection means.

10. In combination, a golf club grid having an inner diameter, a golf club shaft having an outer diameter, said shaft extending a substantial distance within said grip, means for attaching said shaft to said grip, said shaft outer diameter being at least 1/32" less than the inner diameter of said grip wherein a cavity is formed between said shaft and said grip and wherein said means for attaching said shaft comprises first attaching means at or near one end of said grip and second attaching means 3" or less from the other end of said grip, and wherein said means for attaching at least partially encloses said cavity formed between said shaft and said grip.

11. The combination of claim 10 wherein said second attaching means forms one wall of said cavity.

12. The combination of claim 10 wherein said shaft is eccentrically located within said cavity.

13. The combination of claim 10 wherein said cavity between said shaft and said grip is enclosed and extends for substantially the entire length of said grip.

14. The golf club of claim 10 wherein said grip is comprised of a body having a modulus of elasticity substantially in excess of 2,000,000 psi and wherein said grip also has an outer covering which is substantially softer than said body of said grip.

15. The golf club of claim 10 wherein said grip and said first and second means for attaching said shaft to said grip are comprised of one or more materials are selected from the group consisting of metals, polymers, carbon, graphite, Kevlar, ceramics, boron, graphite boron, ceramics, alloys, metal mixtures and metal compounds.

16. A playing golf club comprising a grip, a shaft having two ends, a head, first means connecting said grip to one of said ends of said shaft, wherein said shaft extends substantially through said grip to within approximately 1", or less, of the distal end of said grip from said head, and second means connecting said head to the other of said ends of said shaft, and wherein said grip, said shaft and said first means form two cavities, one cavity being a closed cavity and the other cavity being an open cavity which is substantially shorter in length than said closed cavity and in which said open cavity is approximately 3" or less in length.

17. A playing golf club comprising a grip, a shaft having two ends, a head, first means connecting said grip to one of said ends of said shaft, wherein said shaft extends substantially through said grip to within approximately 1", or less, of the distal end of said grip from said head, and second means connecting said head to the other of said ends of said shaft, and wherein said first connecting means comprises a sleeve of from approximately 0.4" to 4" long, said shaft being inserted in said sleeve and said sleeve being inserted in said grip and wherein said sleeve is disposed farther from said distal end of said grip than from the end of said grip nearer said head.

18. The golf club of claim 17 wherein said shaft extends a substantial distance beyond the end of said sleeve, into said grip.

* * * * *